US010240278B2

(12) United States Patent
Chua et al.

(10) Patent No.: US 10,240,278 B2
(45) Date of Patent: Mar. 26, 2019

(54) STEAM IRON HEAD

(71) Applicant: KONINKLIJKE PHILIPS N.V., Eindhoven (NL)

(72) Inventors: Hee Keng Chua, Eindhoven (NL); Boon Khian Ching, Eindhoven (NL); Yong Jiang, Eindhoven (NL); Boon Teck Tan, Eindhoven (NL); Jiecong Tang, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 14 days.

(21) Appl. No.: 15/504,815

(22) PCT Filed: Aug. 26, 2015

(86) PCT No.: PCT/EP2015/069506
§ 371 (c)(1),
(2) Date: Feb. 17, 2017

(87) PCT Pub. No.: WO2016/030406
PCT Pub. Date: Mar. 3, 2016

(65) Prior Publication Data

US 2017/0275810 A1 Sep. 28, 2017

(30) Foreign Application Priority Data

Aug. 26, 2014 (EP) ..... 14182189

(51) Int. Cl.
*D06F 75/06* (2006.01)
*D06F 75/12* (2006.01)
*D06F 75/20* (2006.01)

(52) U.S. Cl.
CPC ..... *D06F 75/06* (2013.01); *D06F 75/12* (2013.01); *D06F 75/20* (2013.01)

(58) Field of Classification Search
CPC ..... D06F 75/06; D06F 75/12; D06F 75/20; D06F 75/02; D06F 75/10; D06F 75/22; D06F 75/24; D06F 75/36; D06F 75/38
See application file for complete search history.

(56) References Cited

U.S. PATENT DOCUMENTS 1,045,179 A * 11/1912 Price ..... D06F 75/12 38/77.6
1,065,873 A * 6/1913 Kako ..... D06F 75/12 38/77.6

(Continued)

FOREIGN PATENT DOCUMENTS

CN 202090208 U * 12/2011
EP 0799927 A2 * 10/1997

(Continued)

*Primary Examiner* — Ismael Izaguirre

(57) ABSTRACT

A steam iron head (2) employs a soleplate (6) having a fabric contact surface (10), a steam inlet (21) through which steam flows to the steam iron head (2), and one or more steam vents (49). A steam passageway (19) is between the steam inlet (21) and the steam vent(s) (49). A fluid separator (25) is located between the steam passageway (19) and the steam vents (49). The fluid separator (25) is configured to restrict the flow of condensation formed in the steam passageway (19) from passing through the steam vent(s) (49). A soleplate panel (7) forms the fabric contact surface (10) and a base (15, 20) of the steam passageway (19). The soleplate panel (7) is configured to be primarily heated by steam flowing along the steam passageway (19) to the steam vent(s) (49). A steam generator system iron may employ the steam iron head (2).

13 Claims, 4 Drawing Sheets

(56) References Cited

U.S. PATENT DOCUMENTS

| | | | | | |
|---|---|---|---|---|---|
| 1,447,535 | A * | 3/1923 | De Atley | D06F 75/06 | 38/77.6 |
| 1,593,897 | A * | 7/1926 | Brewer | D06F 75/12 | 38/77.6 |
| 1,672,040 | A * | 6/1928 | Rubenstein | D06F 75/06 | 38/77.6 |
| 2,160,421 | A * | 5/1939 | Sebo | D06F 75/12 | 38/77.6 |
| 2,285,757 | A * | 6/1942 | Smith | D06F 75/12 | 38/77.6 |
| 2,803,073 | A * | 8/1957 | Raihle | D06F 75/16 | 38/77.82 |
| 3,414,993 | A | 12/1968 | Naomoto | | |
| 4,594,800 | A * | 6/1986 | Herrmann | D06F 75/18 | 38/77.83 |
| 5,619,813 | A | 4/1997 | Forest | | |
| 5,832,639 | A | 11/1998 | Muncan | | |
| 5,883,358 | A * | 3/1999 | Brandolini | D06F 75/24 | 219/257 |
| 2008/0040954 | A1* | 2/2008 | Yu | D06F 75/12 | 38/85 |
| 2010/0326977 | A1* | 12/2010 | Lee | D06F 75/24 | 219/228 |
| 2012/0042547 | A1 | 2/2012 | Pang | | |
| 2012/0102792 | A1 | 5/2012 | Jeon | | |

FOREIGN PATENT DOCUMENTS

| | | | | |
|---|---|---|---|---|
| EP | 1270796 | A1 | | 1/2003 |
| FR | 1142395 | A | | 9/1957 |
| GB | 588152 | A | * | 5/1947 |
| JP | 0698998 | A | | 4/1994 |
| WO | 2008065619 | A1 | | 6/2008 |

* cited by examiner

STEAM IRON HEAD

This application is the U.S. National Phase application under 35 U.S.C. § 371 of International Application No. PCT/EP2015/069506, filed on Aug. 26, 2015, which claims the benefit of International Application No. 14182189.2 filed on Aug. 26, 2014. These applications are hereby incorporated by reference herein.

FIELD OF THE INVENTION

The present invention relates to a steam iron head. The present invention also relates to a domestic steam generator system iron having a steam iron head.

BACKGROUND OF THE INVENTION

Steam irons are used to remove creases from fabric, such as clothing and bedding. Steam irons comprise a body with a handle, so a user can manoeuvre the steam iron, and a soleplate which is placed in contact with the fabric to be ironed. The soleplate is heated to aid the removal of creases when ironing the fabric.

Conventionally, the boiler in the base unit provides steam to the soleplate through a hose, and the soleplate is provided with an embedded heating element. Steam can condense when travelling through the hose and therefore, the heating element heats and maintains the soleplate at a desired temperature to help remove creases, evaporate condensed water, and prevent steam, supplied through holes in the soleplate, from condensing.

However, steam irons are typically heavy due to, for example, the inclusion of the heating element to generate steam. In order to improve the efficiency of the steam generation, the mass of the soleplate is typically high so that it can store more heat. This makes it difficult for the user to manoeuvre the steam iron for long periods of time. The energy consumption of the heating element also limits the steam output produced by the boiler of a steamer which reduces the effectiveness of the steam iron.

It is commonly known in the dry cleaning service and other industrial laundry services to have steam irons that only use steam to remove creases from fabric. Pressurised steam is continuously circulated in a pressure chamber in order to maintain the high temperature of the steam iron. However, this is known to be inefficient and causes condensation.

SUMMARY OF THE INVENTION

It is an object of the invention to provide a steam iron head which substantially alleviates or overcomes the problems mentioned above.

The invention is defined by the independent claims; the dependent claims define advantageous embodiments.

According to the present invention, there is provided a steam iron head comprising a soleplate having a fabric contact surface, a steam inlet through which steam flows to the steam iron head, at least one steam vent, and a steam passageway between the steam inlet and the at least one steam vent. The steam iron head also comprises a fluid separator between the steam passageway and the at least one steam vent configured to restrict flow of condensation formed in the steam passageway from passing through the at least one steam vent. The soleplate has a soleplate panel forming the fabric contact surface and a base of the steam passageway, and the soleplate panel is configured to be primarily heated by steam flowing along the steam passageway to the at least one steam vent.

With this arrangement, it is possible to remove the need for a heater to heat the fabric contact surface to a sufficient operating temperature. This means that the weight of the steam iron head may be significantly minimised. This helps minimise the power consumption of the steam iron head. The latent heat released during condensation of steam in the soleplate is so large that the temperature of the fabric contact surface can be maintained relatively constant, even during the ironing process. Therefore, the efficiency and effectiveness of the steam iron head is maximised.

The temperature of the soleplate panel may be configured to decrease when the steam is not flowing along the steam passageway.

This means that overheating of the soleplate panel may be restricted.

The area of the base of the steam passageway may be at least 70% of the area of the fabric contact surface.

Therefore, it is possible to provide a uniform heat distribution across the soleplate panel as substantially all the soleplate panel is exposed to steam flowing through the steam passageway. Furthermore, the need for a heater to heat the soleplate is removed and the weight of the steam iron head can be minimised allowing the user to use the iron for longer without tiring.

The steam passageway may have a labyrinth configuration.

The labyrinth configuration of the steam passageway guides steam on a pre-defined path ensuring that steam flows along a path extending along substantially all of the soleplate panel. The labyrinth configuration also forces steam to change direction which causes collisions between the surfaces defining the steam passageway and steam particles of the steam flow. In these collisions heat is transferred to the at least one wall from the steam. This encourages heat transfer and a uniform heat distribution. In the labyrinth configuration, any condensed water is pushed by the steam towards the steam vents which minimises the accumulation of water in the steam passageway. This helps to prevent the formation of cold zones on the soleplate panel due to accumulation of water and further condensation.

The steam passageway may extend in a spiralling pattern around the shape of the soleplate panel.

By extending in a spiralling pattern around the shape of the soleplate panel, a continuous path can be formed to cover the soleplate panel. Therefore, the efficiency of the soleplate panel can be maximised. A spiralling pattern helps to reduce the flow resistance in the steam passageway.

The steam passageway may be defined by at least one wall upstanding from the soleplate panel.

With this arrangement, heat energy transferred to the walls may be conducted to the soleplate panel. Furthermore, condensation in the steam passageway may be minimised.

The thickness of the soleplate panel between the base and the fabric contact surface may be less than (or equal to) 2 mm.

By minimising the thickness of the soleplate panel, the mass of the soleplate may be minimised. The amount of energy needed to maintain the temperature of the soleplate panel is also reduced. Therefore, the user can use the steam iron head for longer periods and the condensation of steam inside the steam passageway is minimised.

The fluid separator restricts condensation flowing from the steam vents to a fabric to be treated. Therefore, wet spots on the fabric may be prevented. The fluid separator helps to ensure that only dry steam exits the at least one steam vent.

This helps to reduce the amount of 'spitting' that occurs during use of the steam iron head.

As the fluid separator is between the steam passageway and the at least one steam vent, any condensation formed in the steam passageway will pass through the fluid separator. It has been found that by heating the soleplate panel by steam with the above arrangement, it is possible for condensation to form in the steam passageway due to temperature variations over time of the soleplate panel. By providing a fluid separator, it is possible to ensure that the effect of condensation, for instance 'spitting' is minimised.

The fluid separator comprises a cyclonic chamber.

Therefore, the fluid separator may be simple and light weight. The cyclonic chamber also provides a passive solution which is operational whenever there is a steam flow. A cyclonic chamber is also able to separate the fluids at high velocity.

The steam iron head may further comprise a liquid removal arrangement configure to remove liquid separated from steam by the fluid separator.

Therefore, the fluid separator does not become full of water when the steam iron is used for long periods. The separated liquid is prevented from flooding the fluid separator and exiting onto the fabric being treated. Furthermore, the liquid removal arrangement restricts water from collecting and cooling which may cause further condensation of steam entering the fluid separator to occur.

The liquid removal arrangement may comprise a return path to a liquid reservoir.

Waste water can be re-used by returning it to a liquid reservoir in the steam generating unit. Therefore, the liquid reservoir does not have to be filled up as often which prolongs usage of the steam iron head between refills of the water reservoir.

The liquid removal arrangement may comprise a heater to evaporate liquid separated from steam by the fluid separator.

The condensed steam can be re-evaporated and used to treat the fabric. Therefore, there is no waste water that needs to be returned to the liquid reservoir. Furthermore, as the amount of condensed steam is small, only a small, low power heater is required and so the weight of the steam iron head may be minimised.

The steam iron head may further comprise a user input connected to a steam valve configured to control the flow of steam through the steam passageway.

This means that the user is able to control when steam flows through the soleplate to be used to heat the soleplate or treat the fabric. Furthermore, the heat energy in the steam is not wasted in continuously heating the soleplate when it is not in use and/or needed.

The steam valve may be disposed between the steam inlet and the steam generator unit.

With this arrangement, steam is restricted from being retained in the steam passageway and cooling when steam flow is prevented. This restricts steam from condensing in the steam passageway.

The invention also relates to a steam generator system iron comprising the steam iron head as described above.

The steam generator system iron may comprise a steam generator unit configured to provide pressurised steam.

Therefore, the steam generator unit can have a high steam rate. This enables the steam generator iron system to produce more steam for more effective ironing. The high steam pressure encourages steam to flow through the steam iron head.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

Figure 1:
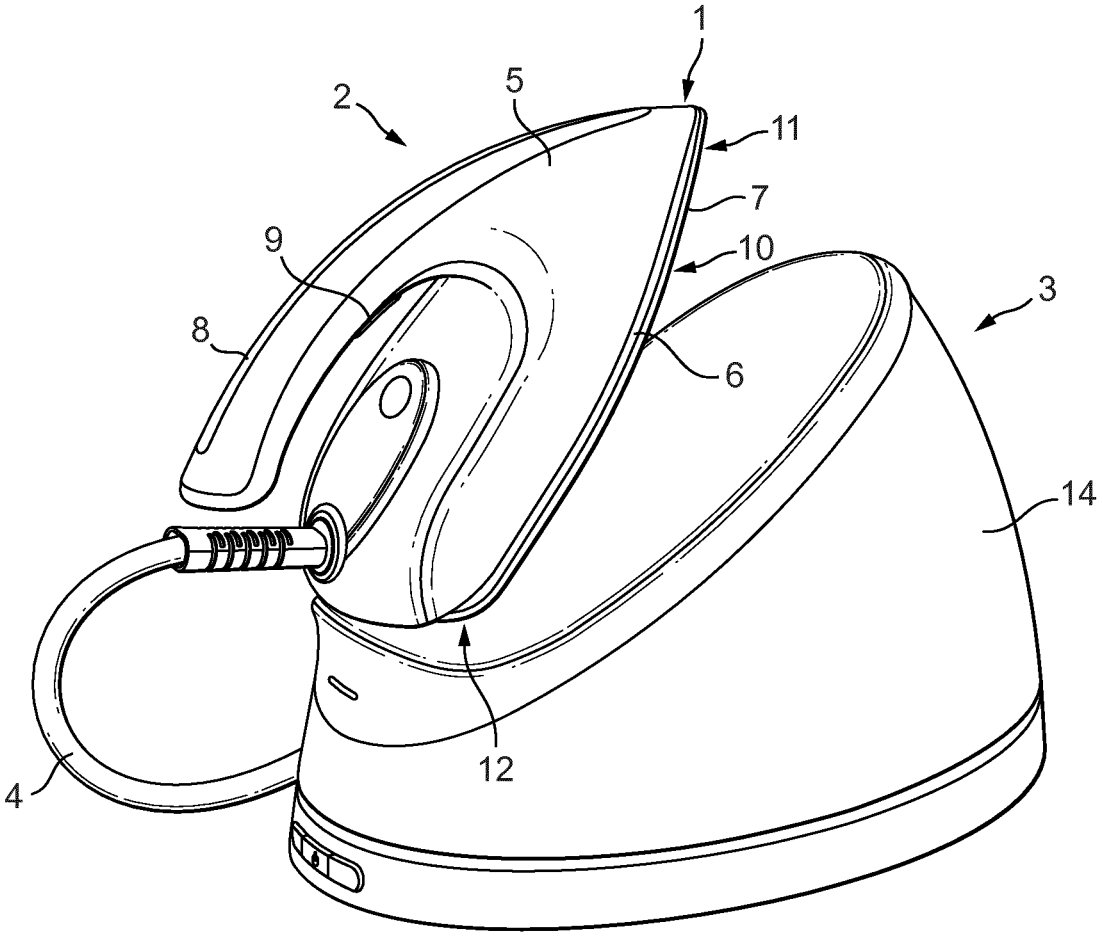
FIG. 1 shows a schematic perspective view of a steam generator system iron according to the invention having a steam iron head.

A steam generator system iron 1 according to the invention is shown in FIG. 1. It comprises a steam iron head 2 and a steam generating unit 3. The steam iron head 2 and the steam generating unit 3 are fluidly connected by a hose 4. The hose 4 is flexible to enable a user to manoeuvre the steam iron head 2 easily. The hose 4 may be a sheath which wraps together at least one pipe or wires which extend from the steam iron head 2 to the steam generating unit 3. The steam iron head 2 comprises a housing 5 and a soleplate 6. The soleplate 6 comprises a soleplate panel 7. The soleplate panel 7 forms a lower end of the steam iron head 2.

The housing 5 comprises a handle 8. The handle 8 enables the user to hold and manoeuvre the steam iron head 2. The steam iron head 2 also comprises a user input 9. The user input 9 is used to control the operation of a steam valve (not shown) which opens to provide the steam iron head 2 with steam from the steam generating unit 3.

The soleplate 6 comprises a fabric contact surface 10. The fabric contact surface 10 is arranged to be placed against a fabric to be ironed. A lower side of the soleplate panel 7 defines the fabric contact surface 10. In an alternative embodiment, the soleplate 6 may further comprise a fabric contact plate (not shown). The fabric contact plate has a fabric contact surface (not shown) and a soleplate panel contact surface (not shown). The fabric contact plate may be a layer of material, for example, but not limited to aluminium or stainless steel, which has good thermal contact with the soleplate panel 7.

The soleplate 6 has a front end 11 and a rear end 12. The soleplate 6 converges towards the front end 11. Therefore, the fabric contact surface 10 of the soleplate 6 has a generally triangular profile. However, it will be understood that the soleplate 6 may have alternative configurations. The hose 4 connects to the steam iron head 2 proximate to the rear end 12 of the soleplate 6.

The steam generating unit 3 comprises a water reservoir 14 and a boiler (not shown). Water is fed to the boiler from the water reservoir 14. Water fed to the boiler is evaporated into steam. Steam generated by the boiler is then fed to the steam iron head 2 via the hose 4. The steam generator unit 3 may also be an instantaneous steam generator. Steam exits the soleplate 6 of the steam iron head 2 through at least one steam vent 49, shown in FIG. 2, towards the fabric to be ironed. The steam helps to increase the effectiveness of the steam iron head 2.

Figure 2:
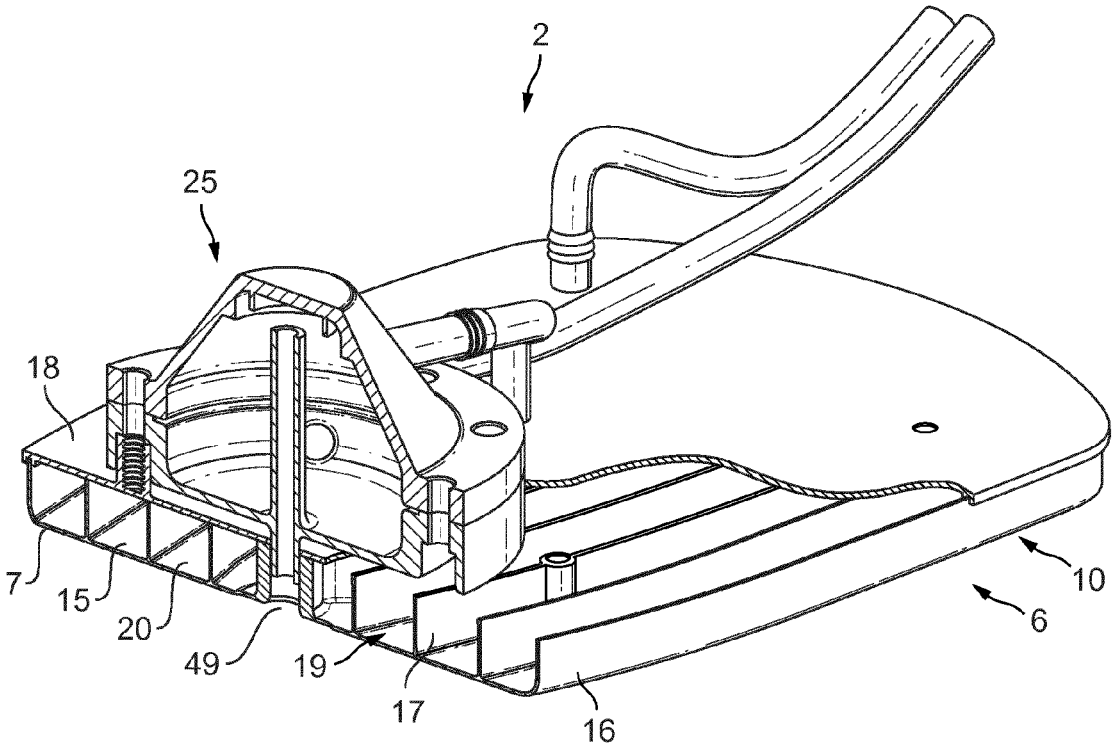
FIG. 2 shows a schematic perspective view of part of the steam iron head of FIG. 1 with a front portion of the steam iron head cut-away to show the internal structure and a section of a cover cut away.

Referring to FIG. 2, the steam iron head 2 is shown without the housing 5, refer to FIG. 1, and with the front end 11 of the steam iron head 2 removed. The part of the steam iron head 2 shown in FIG. 2 comprises the soleplate 6. An upper side of the soleplate panel 7 of the soleplate 6 comprises a top surface 15. The top surface 15 is distal to the fabric contact surface 10. The soleplate panel 7 comprises the fabric contact surface 10 and the top surface 15. The soleplate panel 7 has a thickness less than (or equal to) 2 mm. The thickness of the soleplate 7 panel may be greater than or equal to 0.5 mm. The thickness of the soleplate panel 7 may be less than (or equal to) 0.8 mm.

A peripheral wall 16 upstands from the peripheral edge of the top surface 15 of the soleplate panel 7. The peripheral wall 16 extends around the perimeter of the soleplate panel 7. In the present embodiment, the peripheral wall 16 protrudes perpendicularly from the edge of the top surface 15. However, it will be understood that in an alternative embodiment the peripheral wall 16 may protrude from the soleplate panel 7 at a different angle. The peripheral wall 16 is integrally formed with the soleplate panel 7.

The steam iron head 2 further comprises an internal wall 17 which upstands from the top surface 15 of the soleplate panel 7. The internal wall 17 is integrally formed with the soleplate panel 7. A cover 18, shown in FIG. 2, extends from the upper ends of the peripheral wall 16 and internal wall 17. The cover 18 is part of the soleplate 6. Alternatively, the cover 18 may be a bottom wall (not shown) of the housing 5 of the steam iron head 2. A steam passageway 19 extends along the soleplate 6. The steam passageway 19 defines a steam path along which steam is able to flow. The steam passageway 19 is formed by the soleplate panel 7, the peripheral wall 16, the internal wall 17, and the cover 18. The steam passageway 19 extends along the soleplate panel 7.

The top surface 15 of the soleplate panel 7 defines a base 20 of the steam passageway 19. The peripheral wall 16 and internal wall 17 form side walls of the steam passageway 19. The cover 18 forms a top wall of the steam passageway 19. The soleplate panel 7, peripheral and internal walls 16, 17 and cover 18 form steam contact walls of the soleplate 6. A surface of the peripheral wall 16, the internal wall 17, the cover 18, and the base 20 form steam contact surfaces.

In the present embodiment, steam flows into the steam passageway 19 in the steam iron head 2 via steam passageway inlet 21. Steam then flows along the steam passageway 19 and into a fluid separator 25. The fluid separator 25 separates water from the steam. Steam then exits the fluid separator 25 and passes through the steam vents 49 and onto the fabric being ironed.

In the present embodiment, the internal wall 17 is a single wall. However, it will be understood that the internal wall 17 may have a plurality of spaced sections. The internal wall 17 upstands from the soleplate panel 7. The steam passageway 19 has a spiral arrangement. In the present arrangement this is formed by the internal wall 17 extending in a spiral arrangement. The path of the steam passageway 19 extends from the peripheral wall 16 towards the centre of the top surface 15 of the soleplate 6. The area of the base 20 of the steam passageway 19 substantially corresponds to the area of the fabric contact surface 10. That is, the base 20 and the fabric contact surface 10 have substantially the same surface area.

Figure 3:
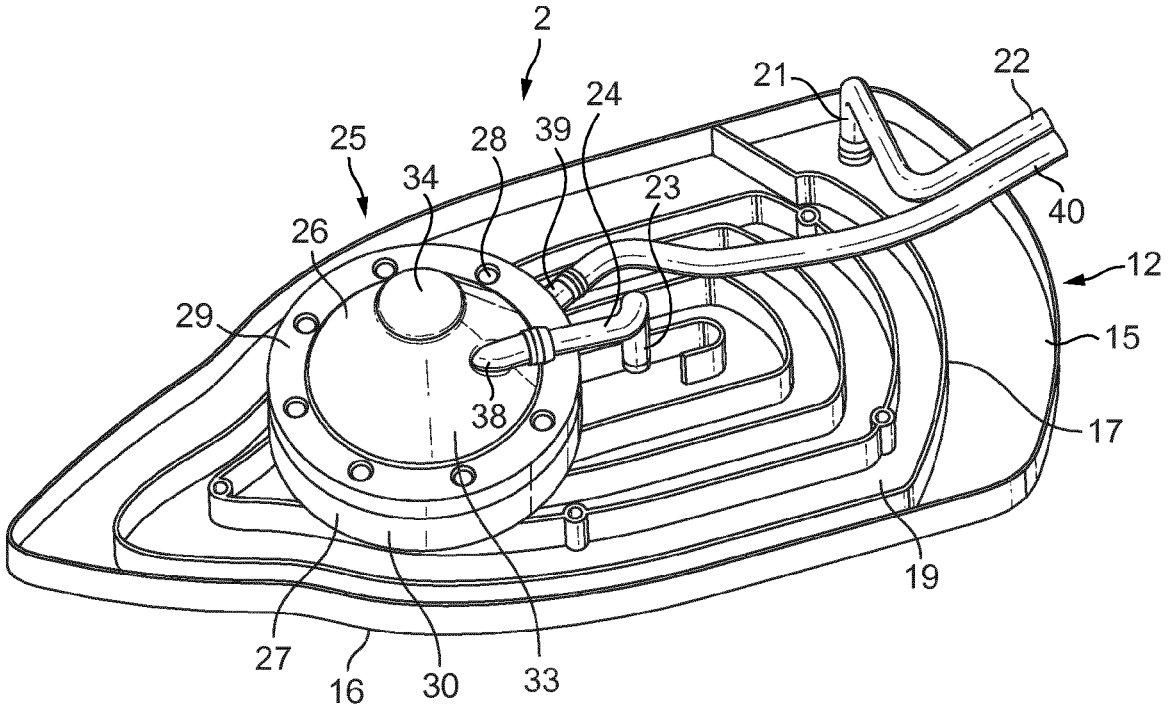
FIG. 3 shows a schematic cut-away perspective view of part of the steam iron head of FIG. 1 with the cover omitted.

Referring to FIG. 3, the steam passageway 19 has a labyrinth configuration. That is, the steam does not flow from the steam passageway inlet 21 in a straight line directly to a steam passageway outlet 23. The steam passageway 19 changes direction at least once so that the direction of the steam flow is changed at least once. This enables steam to flow over a larger area of the top surface 15 of the soleplate panel 7. The labyrinth configuration also causes steam to collide with the steam contact surfaces 16, 17, 18, 20 heating up the soleplate 6. The labyrinth may be unicursal, i.e. have a single path, or multicursal, having multiple paths or branches. In the present embodiment, the labyrinth configuration of the steam passageway 19 is in the form of a spiralling pattern around the shape of the soleplate panel 7.

For example, the labyrinth configuration of the steam passageway 19 may be a single pathway along which steam flows from the rear end 12 of the steam iron head 2 towards the front end 11 and back multiple times whilst moving from the right side of the steam iron head 2 to the left.

In the present embodiment, as shown in FIG. 2 and FIG. 3, the steam passageway 19 is configured to extend across the whole of the top surface 15 of the soleplate panel 7. Therefore, steam from the steam generating unit 3 is passed substantially over the whole of the soleplate panel 7. This encourages a uniform heat distribution across the top surface 15 of the soleplate panel 7 which acts as the base 20 of the steam passageway 19.

The uniform heat distribution helps to prevent localised cold spots on the base 20 of the steam passageway 19 that would condense steam flowing along the steam passageway 19.

The spiral pattern labyrinth of the present embodiment, shown in FIG. 2 and FIG. 3, helps to reduce the flow resistance in the steam passageway 19. The solitary passageway helps to prevent the accumulation of condensed water in the steam passageway 19.

The steam passageway 19 has a generally rectangular cross-section, although it will be understood that the cross-section of the steam passageway 19 may be another shape, for example, but not limited to, circular, elliptical, or triangular. In the present embodiment, the steam passageway 19 is the solitary path that the steam must take when passing through the soleplate 6 of the steam iron head 2.

However, it will be understood that the present invention is not limited to having a single internal wall 17 protruding from the top surface 15 of the soleplate panel 7. Furthermore, it will be understood that by using more than one internal wall 17, a single steam path can be created using a single steam passageway 19. Alternatively, more than one steam path through multiple steam passageways 19 can be created in the steam iron head 2 from the steam passageway inlet 21 to the at least one steam vent 49. It is possible to determine the suitable number of steam paths and corresponding walls needed for a specific embodiment. In an alternative embodiment, the soleplate 6 may further comprise a steam distribution channel (not shown) configured to allow steam to be distributed to multiple steam vents 49.

The soleplate 6 comprises the steam passageway inlet 21. The steam passageway inlet 21 is in the cover 18. The steam passageway inlet 21 is located proximate to the rear end 12 of the soleplate 6. A steam delivery pipe 22 delivers steam from the steam generating unit 3 through the steam passageway inlet 21 into the steam passageway 19. The steam delivery pipe 22 extends through the hose 4 from a steam generating unit steam outlet (not shown). The steam delivery pipe 22 is flexible to enable the user to easily manoeuvre the steam iron head 2.

The soleplate 6 comprises the steam passageway outlet 23. As shown in FIG. 3, the steam passageway outlet 23 is in the cover 18. The steam passageway outlet 23 is located centrally in the cover 18 of the soleplate 6. A steam transfer pipe 24 transfers steam out of the steam passageway 19 in the soleplate 6 and into the fluid separator 25.

The soleplate 6 is heated up by the latent heat of the steam. When the steam contacts the steam contact surfaces, i.e. the base 20 of the steam passageway 19, the peripheral wall 16, the internal wall 17, and the cover 18, it transfers some of its heat energy to the soleplate 6. The top surface 15 of the soleplate panel 7 transfers the heat through the soleplate panel 7 to the fabric contact surface 10. In this way steam heats the soleplate 6 to the temperature of the steam. Furthermore, because the steam passageway 19 distributes the steam substantially across the whole of the soleplate 6, the soleplate 6 heats up uniformly. However, as steam contacts the steam contact surfaces 16, 17, 18, 20 energy from the steam is transferred to the steam contact surfaces 16, 17, 18, 20 which may cause some of the steam to condense in the steam passageway 19.

Therefore, in order to reduce the rate of condensation occurring along the steam passageway 19, the steam contact walls 7, 16, 17, 18, having steam contact surfaces 16, 17, 18, 20 that define the steam passageway 19, have a combined mass of less than 0.4 kg in a typical embodiment. The steam contact walls 7, 16, 17, 18 may, for instance, have a combined mass of less than 0.3 kg. In particular, the soleplate panel 7, and the peripheral and internal walls 16, 17 have a mass configured to minimise the amount of heat energy required to heat them up to the steam temperature. However, as the material that the steam contact walls 7, 16, 17, 18 are made from has a set density, in order to minimise the mass of the steam contact walls 7, 16, 17, 18 the amount of material used to make them is minimised.

Therefore, the soleplate panel 7, and peripheral and internal walls 16, 17 have a thickness as low as 0.5 mm to minimise the mass. By minimising the mass of the steam contact walls 7, 16, 17, 18 the amount of energy required to heat the soleplate 6 to the desired temperature is also minimised. The steam contact surfaces 16, 17, 18, 20 will heat up to the same temperature as the steam quickly and so the amount of time in which condensation can occur in the steam passageway 19 is reduced. Therefore, the heat capacity of the steam iron head 2 is reduced.

This is useful because steam is not continuously re-circulated around the soleplate 6 and back to the steam generating unit 3. Not continuously re-circulating steam through the soleplate 6 helps to save energy and makes the steam generator system iron 1 more efficient.

In the present embodiment, the soleplate panel 7, peripheral wall 16, and internal wall 17 are configured to heat up to the temperature of the steam and transfer the heat through the soleplate 6. The soleplate panel 7, peripheral wall 16, and internal wall 17 are formed from, for example, but not limited to aluminium or magnesium alloys.

Although the cover 18 is configured to heat up to prevent condensation and to transfer heat through the soleplate 6, it can alternatively be configured to prevent heat escaping from the steam passageway 19 and into the housing 5 of the steam iron 2. In this way the cover 18 also acts as an insulator. Therefore, the cover 18 may be formed from a material with low thermal conductivity and density. The cover 18 may be formed from, for example, but not limited to polypropylene or polyamide. In one embodiment, the cover 18 may have an insulating layer (not shown) formed from a material having a low thermal conductivity, such as, but not limited to EPP (expanded polypropylene). This helps to prevent heat escaping into the housing 5.

In the present embodiment, the user operates the user input 9, refer to FIG. 1, to open the steam valve (not shown) and allow steam to flow along the steam passageway 19. Therefore, the soleplate 6 of the steam iron head 2 and steam will experience the largest difference in temperature at the point when the steam valve is opened and steam is first introduced into the steam passageway 19. The low mass, achieved by making the steam contact walls 7, 16, 17, 18 of the steam passageway 19 thin allows the temperature difference to be reduced quickly, preventing the formation of condensation and increasing the efficiency of the steam generator system iron 1.

The further along the steam passageway 19 the steam travels, the more heat energy the steam loses to the steam contact surfaces 16, 17, 18, 20. Therefore, by having a high heat transfer coefficient the areas of the soleplate 6 which are further away from the steam passageway 19 can be effectively heated.

Steam flows along the steam passageway 19 from the steam passageway inlet 21 along a path around the periphery of the soleplate panel 7, adjacent to the peripheral wall 16. The steam valve (not shown) is disposed between the steam passageway inlet 21 and the exit of the steam generating unit 3. The steam valve may be disposed in the steam passageway inlet 21. Therefore, steam is not stored in the steam passageway 19. In an alternative embodiment, the steam valve is disposed at the exit of the steam generating unit 3 so that steam is not stored in the hose 4 further reducing the amount of condensation in the steam flow.

Steam flows around the perimeter of the soleplate panel 7 to the point where the internal wall 17 extends from the peripheral wall 16. Steam then flows along a path around the soleplate 6 defined by the internal wall 17 through the inner sections of the steam passageway 19, circling in closer to the centre of the soleplate panel 7, until the steam arrives at the steam passageway outlet 23 which is located centrally in the cover 18.

The part of the steam iron head 2 shown in FIG. 2 and FIG. 3 comprises the fluid separator 25. The fluid separator 25 is located on top of the cover 18 on the longitudinal axis of the steam iron head 2. The fluid separator 25 is located between the steam passageway outlet 23 of the cover 18 and the front end 11 of the soleplate 6. However, it will be understood that in an alternative embodiment the fluid separator 25 may be located in an alternative position on the cover 18 of the soleplate 6. Alternatively, the fluid separator 25 may be located within the soleplate 6.

The fluid separator 25 comprises a casing formed of an upper casing 26 and a lower casing 27. The upper and lower casings 26, 27 are generally cylindrical. The upper and lower casing 26, 27 attach to each other via screws (not shown), or some other attachment arrangement, which extend through fixing holes 28 in an upper casing side wall 29 and a lower casing side wall 30 on the outer edge of the upper and lower casings 26, 27, respectively. The screws also fix the fluid separator 25 to the cover 18 of the soleplate 6. In an alternative embodiment, the upper and lower casings 26, 27 may be integrally formed.

Figure 4:
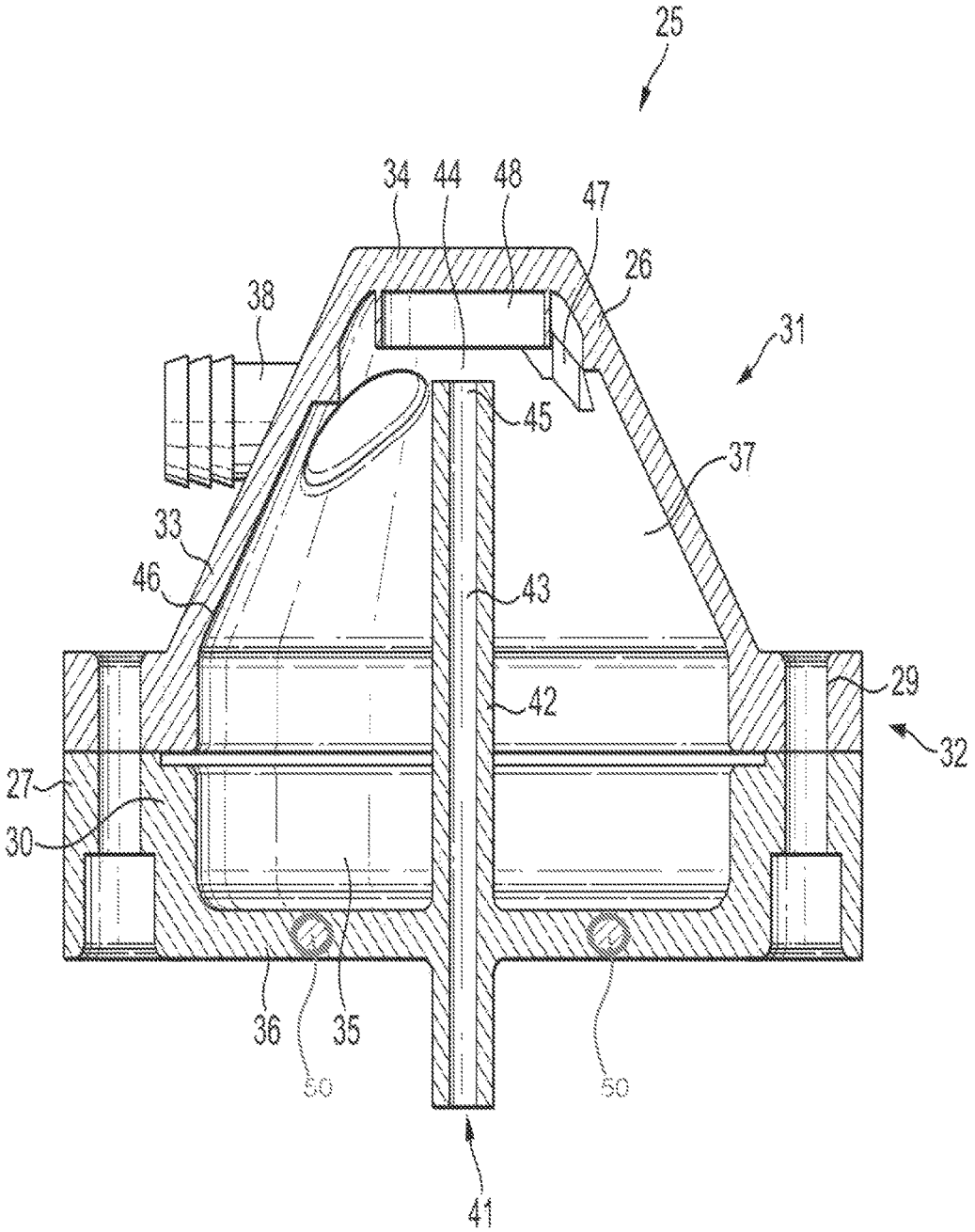
FIG. 4 shows a schematic cross-sectional side view of a fluid separator of the steam iron head of FIG. 1.

Referring now to the cross-sectional view of the fluid separator 25 shown in FIG. 4, the upper casing 26 comprises a frusto-conical section 31. The frusto-conical section 31 protrudes from an upper cylindrical section 32 defined by the upper casing side wall 29. The upper casing is hollow. Therefore, the frusto-conical section 31 comprises a lateral wall 33 and a top wall 34. The cylindrical section 32 comprises the upper casing side wall 29. The lower casing 27 comprises a hollow lower cylindrical section which acts as a water collection section 35. The water collection section 35 comprises the lower casing side wall 30 and a base wall 36. When attached the upper and lower casings 26, 27 form an internal fluid separation chamber 37. In the present embodiment, the fluid separation chamber 37 is a cyclonic chamber.

Referring back to FIG. 3, the upper casing 26 further comprises a fluid inlet 38. The fluid inlet 38 is located in the lateral wall 33 proximate to the top wall 34 of the upper casing 26. The fluid inlet 38 is connected to the steam transfer pipe 24. A fluid mixture of steam and condensation enters the fluid separator 25 from the steam passageway 19 in the soleplate 6 via the steam transfer pipe 24 and the fluid inlet 38. The fluid inlet 38 is positioned so that steam and condensation enters the fluid separation chamber 37, shown in FIG. 4, tangentially, with respect to the circular lateral wall 33, as will be explained in more detail hereinafter.

The lower casing 27 of the fluid separator 25 further comprises a water outlet 39. The water outlet 39 is located in the lower casing side wall 30 proximate to the base wall 36. The water outlet 39 is connected to a water return pipe 40. The water return pipe 40 is flexible. This helps the user to manoeuvre the steam iron head 2 easily. The water return pipe 40 transfers water to the water reservoir 14 of the steam generating unit 3 through the hose 4, as will be described in more detail hereinafter.

FIG. 4 shows that the fluid separator 25 comprises a further outlet. The lower casing 27 comprises a dry steam outlet 41 in the base wall 36. The dry steam outlet 41 is formed by an aperture in the base wall 36. The aperture is located in the centre of the base wall 36.

The dry steam outlet 41 is configured to prevent condensed steam from exiting the fluid separation chamber 37 through the dry steam outlet 41 and being discharged onto the fabric being ironed.

In order to achieve this, an open ended cylindrical tube 42 protrudes perpendicularly from the base wall 36 towards the top wall 34 of the upper casing 26. The open ended cylindrical tube 42 defines a dry steam exit path 43 through the dry steam outlet 41. The open ended cylindrical tube 42 also protrudes perpendicularly downwards from the base wall 36. A gap 44 exists between a top end 45 of the open ended cylindrical tube 42 and the top wall 34 of the upper casing 26 so that steam can exit the fluid separation chamber 37 through the dry steam outlet 41. The steam is known as 'dry steam' because it contains a minimal amount of condensation.

In the present embodiment, the fluid separator 25 is a cyclone chamber. The fluid separator 25 is able to separate steam from condensation by centrifugal force. Centrifugal force is caused by the inertia of a body; its resistance to change in motion. The fluid, which is a mixture of steam and condensation, enters the fluid separation chamber 37 via the steam transfer pipe 24, refer to FIG. 3, and the fluid inlet 38 from the steam passageway 19 of the soleplate 6.

The fluid entering the fluid separation chamber 37 is a mixture of steam and condensation because some of the steam heats up the soleplate 6 using its latent energy and therefore, condenses. The heat energy is transferred when the steam particles collide with the steam contact surfaces 16, 17, 18, 20 along the steam passageway 19. As heat is being transferred to the soleplate 6 some of the steam will condense and form water droplets.

The fluid inlet 38 introduces the fluid into the fluid separation chamber 37 through the lateral wall 33 of the frusto-conical section 31 of the upper casing 26. The fluid inlet 38 introduces fluid into the frusto-conical section 31 tangentially. That is, the flow of the fluid is tangential to the lateral wall 33. Therefore, the fluid is instantly required to change direction when it enters the fluid separation chamber 37 because the frusto-conical section 31 has a circular cross-section.

As the fluid changes direction by flowing along an internal surface 46 of the lateral wall 33 it resists the change to its state of motion. Particles with a larger mass resist the change to their state of motion more than particles with a smaller mass. Therefore, the heavier condensed steam (water droplets) resist the change in direction of the flow of the fluid more than the lighter steam. Consequently, the heavier condensed steam (water droplets) flows along the internal surface 46 of the lateral wall 33 and the steam flows closer to the centre of the fluid separation chamber 37.

As the heavier particles are flung towards the lateral wall 33 and flow around its internal surface 46 they collide and form larger drops of water. As the drops of water become larger they begin to travel down the lateral wall 33 towards the base wall 36 of the lower casing 27 under the influence of gravity. The drops of water collect in the lower casing 27 of the fluid separator 25.

The upper casing 26 further comprises at least one rib 47 protruding from the inside surface 46 of the lateral wall 33. The ribs 47 extend at an angle to the direction of the fluid flow. The ribs 47 are configured to induce the fluid to flow in a downward helical path. The upper casing 26 also comprises a barrier 48. The barrier 48 protrudes perpendicularly from the top wall 34. The barrier 48 protrudes downwards towards the lower casing 27. The barrier 48 is circular. The barrier 48 is configured to prevent fluid that enters the fluid separation chamber 37 to exiting the fluid separation chamber 37 directly. The barrier 48 does not necessarily overlap the top end 45 of the open ended cylindrical tube 42 but it does have a larger radius of curvature. The fluid is prevented from going straight to the top end 45 of the open ended cylindrical tube 42 and along the dry steam exit path 43 to the dry steam outlet 41. The ribs 47 and the barrier 48 help to ensure that the fluid is separated and exits the fluid separation chamber 37 through different outlets.

Furthermore, the cross-sectional area of the frusto-conical section 31 increases towards the cylindrical section 32 of the upper casing 26. The fluid mixture of steam and condensation enters the fluid separation chamber 37 under high pressure which is generated in the steam generating unit 3 and released when the steam valve (not shown) is opened.

Any fluid that completes one rotation around the fluid separation chamber 37 encounters high pressure fluid flow still entering the fluid separation chamber 37 and is forced downwards. The increasing cross-sectional area of the frusto-conical section 31 creates a lower pressure which draws the fluid mixture downwards. The fluid flows down towards the base wall 36 of the lower casing 27 in a helical fashion.

As the fluid flows through the larger area to a lower pressure region its velocity also drops. Therefore, the larger water droplets have less energy and are unable to remain mixed in the steam flow so they collate on the lateral wall 33 and fall to collect on the base wall 36. The steam, however, still has enough energy to flow back up towards the top wall 34 of the upper casing 26. The advantage of having the opening of the dry steam exit path 43 proximate to the top wall 34 of the fluid separation chamber 37 is that the steam can not carry water collated on the bottom wall 36 to the dry steam outlet 41. The barrier 48 prevents water exiting the fluid separation chamber 37 straight from the fluid inlet 38.

The build up of pressure in the fluid separation chamber 37 causes the steam to flow to the top end 45 of the open ended cylindrical tube 42. The pressure at the dry steam outlet 41, located at the opposing end of the open ended cylindrical tube 42 to the top end 45, is close to atmospheric. In the present embodiment, the pressure at the dry steam outlet 41 will be atmospheric. In an embodiment comprising the steam distribution channel (not shown the pressure at the dry steam outlet 41 is slightly higher than atmospheric. Therefore, the steam is drawn along the dry steam exit path 43. The steam is known as dry steam because all the water is in a gaseous state. That is, there is a minimal amount of water droplets present in the fluid.

The water droplets which have been separated from the steam collect on the base wall 36 of the lower casing 27. The fluid separator 25 comprises a liquid removal arrangement to remove the water from the fluid separation chamber 37. The water is removed from the fluid separation chamber 37 through the water outlet 39 located in the lower casing side wall 30. The water travels through the water return pipe 40 to the water reservoir 14 in the steam generating unit 3. The water is returned to the steam generating unit 3 by utilising the high steam pressure present in the fluid separation chamber 37. The water can then be re-used.

Referring back to FIG. 2, the fluid separator 25 is located on top of the cover 18 of the soleplate 6. The soleplate 6 further comprises the steam vent 49. The steam vent 49 is an aperture through which steam flows from the steam iron head 2, located directly beneath the centre of the water separator 25. The steam vent 49 fluidly communicates with the fluid separator 25. Therefore, the steam vent 49 fluidly communicates with the steam passageway 19 via the fluid separator 25.

The steam vent 49 is configured to accommodate the bottom end of the open ended cylindrical tube 42 which defines the dry steam outlet 41. The steam vent 49 transfers dry steam from the dry steam exit path 43, via the dry steam outlet 41 of the fluid separator 25, through the soleplate 6 and onto the fabric to be ironed.

A method of using the steam iron head 2 will now be described with reference to the figures. The user switches on the steam generator system iron 1. The steam generating unit 3 then heats the water in the water reservoir 14. The user waits until the heater (not shown) in the steam generating unit 3 has evaporated a sufficient amount of water to build up sufficient pressure. This may be indicated by the switching on or off of a light (not shown) on the steam generating iron 1. The user then grips the steam iron head 2 by the handle 8 and places the fabric contact surface 10 of the soleplate 6 onto the fabric to be ironed.

When the user is ready they operate the user input 9 which opens the steam valve (not shown) allowing the steam to flow from the high pressure in the steam generating unit 3 towards the atmospheric pressure at the dry steam outlet 41 in the steam vent 49. The steam flows through the steam delivery pipe 22 and into the steam passageway 19 in the soleplate 6. As the steam flows through the steam delivery pipe 22 it loses heat to the environment and begins to condense.

The high pressure of the steam forces it along the labyrinth style steam passageway 19. The steam flows along the steam passageway 19 that spirals inwards towards the centre of the soleplate 6. During the steam's path along the steam passageway 19, steam particles collide with the base wall 20 of the steam passageway 19, the peripheral wall 16, the internal wall 17, and the cover 18 of the soleplate 6. In each collision, the steam particle transfers some of its heat to the steam contact surfaces 16, 17, 18, 20. The steam contact walls 7, 16, 17, 18 are thin to reduce the mass of the soleplate 6 and the heat energy required to raise its temperature. Therefore, the steam contact surfaces 16, 17, 18, 20 quickly reach the same temperature as the steam flowing through the steam passageway 19, thereby reducing the amount of condensation that occurs in the steam passageway 19.

Furthermore, the high heat transfer coefficient allows the heat to be transferred around the soleplate 6 to enable parts of the steam passageway 19 that have not yet received the steam to heat up. This reduces the amount of condensation taking place further along the steam passageway 19. In addition, the soleplate 6 receives a uniform heat distribution because steam flows through the steam passageway 19 which extends over the whole of the top surface 15 of the soleplate 6. The heat is transferred through soleplate panel 7 from the top surface 15 to the fabric contact surface 10. The hot fabric contact surface 10 prevents any steam being used to treat the fabric being ironed from condensing on its surface and showing up as wet spots on the fabric.

By using steam to heat the soleplate 6 instead of a heating element, the soleplate 6 does not consume any power. The advantage of this is that a larger amount of power can be supplied to the steam generating unit 3. The steam generating unit 3 can use the power to produce a steam rate of between 60 g/min and 200 g/min. The steam generating unit 3 is configured to provide the steam iron head 2 with pressurised steam. The pressurised steam ensures the steam has sufficient velocity to enable the steam and condensed steam to be separated in the cyclonic chamber. Therefore, the performance of the steam iron head 2 can be enhanced. Furthermore, the soleplate 6 will not overheat as the maximum temperature it can reach is the temperature of the steam. Therefore, the steam iron head 2 is less likely to damage the fabric being ironed. The soleplate panel 7 is also configured to cool down once steam is no longer flowing along the steam passageway 19.

The mixture of steam and condensation then flows into the fluid separator 25. The fluid mixture is separated using the principle of inertia as described in detail above. The heavier water droplets are flung towards the internal surface 46 of the fluid separation chamber 37 where they collate and run down into the water collection section 35 in the lower casing 27. A liquid removal arrangement removes the water and transfers it back to the water reservoir 14 to be re-used.

The lighter steam particles are forced out of the fluid separation chamber 37 by the high pressure steam flowing into the fluid separator 25. As the fluid mixture must rise towards the top wall 34 after being directed downwards by the ribs 47 only the steam has enough energy to exit the fluid separation chamber 37 via the dry steam exit path 43. The dry steam, without any water droplets, is then discharged through the steam vent 49 in the soleplate 6 and onto the fabric to be cleaned. The user manoeuvres the steam iron head 2 across the fabric to distribute the steam and iron out wrinkles.

The user can repeat this process by operating the user input 9 when more steam is needed to either heat the soleplate 6 or treat the fabric.

In an alternative embodiment, the liquid removal arrangement may differ. The condensation may not be sent via the water return pipe 40 to the water reservoir 14 in the steam generating unit 3. In the alternative embodiment (not shown), the condensation may exit the fluid separation chamber 37 via the water outlet 39 and be transferred to a separate evaporation chamber (not shown).

The evaporation chamber may comprise a low power heater (not shown). The low power heater may require less than (or equal to) 300W to be operated. Therefore, the steam iron head 2 can remain light-weight because the heater will be small. The water may be evaporated in the evaporation chamber by the lower power heater and then fed back into the fluid separation chamber 37 or directly onto the fabric via a steam vent. Alternatively, as shown in FIG. 4, a low power heater 50 may be embedded in the lower casing 27 of the water separator 25.

As a result of the features disclosed above, the mass of the steam iron head 2 may be minimised. The mass of the steam iron head 2 may be less than 800 g. It is envisaged that the steam iron head 2 will have a mass of between 400 g and 800 g inclusive. Therefore, the steam iron head 2 may weigh no more than 8N. The advantage of having a light steam iron head 2 is that the manoeuvrability of the steam iron head 2 is increased.

It will be appreciated that the term "comprising" does not exclude other elements or steps and that the indefinite article "a" or "an" does not exclude a plurality. A single processor may fulfil the functions of several items recited in the claims. The mere fact that certain measures are recited in mutually different dependent claims does not indicate that a combination of these measures cannot be used to an advantage. Any reference signs in the claims should not be construed as limiting the scope of the claims.

The invention claimed is:

1. A steam iron head, comprising:

a soleplate having a fabric contact surface, a steam inlet through which steam flows to the steam iron head, at least one steam vent, a steam passageway between the steam inlet and the at least one steam vent, and a fluid separator between the steam passageway and the at least one steam vent configured to restrict the flow of condensation formed in the steam passageway from passing through the at least one steam vent, wherein the soleplate has a soleplate panel forming the fabric contact surface and a base of the steam passageway, and wherein the soleplate panel is configured to be primarily heated by steam flowing along the steam passageway to the at least one steam vent.

2. The steam iron head according to claim 1, wherein the temperature of the soleplate panel is configured to decrease when steam is not flowing along the steam passageway.

3. The steam iron head according to claim 1, wherein the area of the base of the steam passageway is at least 70% of the area of the fabric contact surface.

4. The steam iron head according to claim 1, wherein the steam passageway has a labyrinth configuration.

5. The steam iron head according to claim 1, wherein the steam passageway is defined by at least one wall upstanding from the soleplate panel.

6. The steam iron head according to claim 1, wherein the thickness of the soleplate panel between the base of the steam passageway and the fabric contact surface is less than 2 mm.

7. The steam iron head according to claim 1, wherein the fluid separator includes a cyclonic chamber between the steam passageway and the at least one steam vent configured to restrict the flow of condensation formed in the steam passageway from passing through the at least one steam vent.

8. The steam iron head according to claim 1, further comprising a liquid removal arrangement configured to remove liquid separated from steam by the fluid separator.

9. The steam iron head according to claim 8, wherein the liquid removal arrangement includes a return path to a liquid reservoir.

10. The steam iron head according to claim 9, wherein the liquid removal arrangement comprises a heater to evaporate liquid separated from steam by the fluid separator.

11. A steam generator system iron comprising the steam iron head according to claim 1.

12. The steam generator system iron according to claim 11 further comprising a steam valve configured to control the flow of steam through the steam passageway.

13. The steam generator system iron according to claim 12, wherein the steam iron head further comprises a user input connected to the steam valve configured to control the flow of steam through the steam valve.

* * * * *